US006135197A

United States Patent [19]

Jolivet et al.

[11] Patent Number: 6,135,197

[45] Date of Patent: Oct. 24, 2000

[54] TWO-MATERIAL MOLD FOR THE VERTICAL HOT-TOP CONTINUOUS CASTING OF METALS

[75] Inventors: Jean-Marc Jolivet, Rurange les Thionville; Eric Perrin, Metz; Cosimo Salaris; Jacques Spiquel, both of Montigny les Metz, all of France

[73] Assignees: Ugine Savoie, Ugine; Sogepass, Amneville; Sollac; Ascometal, both of Puteaux, all of France; Societe Anonyme des Forges et Acieries de Dilling, Dillingen/Sarre, Germany

[21] Appl. No.: 09/147,008

[22] PCT Filed: Mar. 27, 1997

[86] PCT No.: PCT/FR97/00545

§ 371 Date: Jan. 25, 1999

§ 102(e) Date: Jan. 25, 1999

[87] PCT Pub. No.: WO97/37791

PCT Pub. Date: Oct. 16, 1997

[30] Foreign Application Priority Data

Apr. 5, 1996 [FR] France ..... 96 04304

[51] Int. Cl.[7] ..... B22D 11/041

[52] U.S. Cl. ..... 164/418; 164/459

[58] Field of Search ..... 164/418, 459, 164/444, 487

[56] References Cited

U.S. PATENT DOCUMENTS 3,381,741 5/1968 Gardner .

FOREIGN PATENT DOCUMENTS 0 213 049 3/1987 European Pat. Off. .
2 690 099 10/1993 France .
5-115961 5/1993 Japan ..... 164/187
57 799 5/1969 Luxembourg .

*Primary Examiner*—J. Reed Batten, Jr.
*Attorney, Agent, or Firm*—Nixon Peabody LLP; Thomas W. Cole

[57] ABSTRACT

The mold includes a cooled copper body 4 on top of which sits a refractory feed head 9 which itself consists of two separate components—a thermally insulating upper bush 16 and a bottom annulus 17 made of a stronger and more compact refractory which is surrounded by a crimping ring 18 narrower than the annulus, so that an edge of the annulus extends beyond each side of the ring. As the lower inner edge of the bottom annulus becomes worn due to an erosive flow of molten metal, the working life of the annulus may be extended in two ways. First, the annulus may be removed between casting operations and its bottom surface may be faced. Second, after the facing operations have rendered the bottom surface flush with the crimping ring 18, the annulus may then be inverted so that the lower inner edge is replaced with the upper inner edge.

3 Claims, 1 Drawing Sheet

Single plate

TWO-MATERIAL MOLD FOR THE VERTICAL HOT-TOP CONTINUOUS CASTING OF METALS

BACKGROUND OF THE INVENTION

The invention relates to the vertical hot-top continuous casting of metals, particularly steel.

DESCRIPTION OF THE PRIOR ART

It is known that vertical hot-top continuous casting is essentially distinguished from conventional vertical continuous casting by the fact that sitting on top of the mold body, made of copper or a copper alloy, vigorously cooled by the circulation of water and defining a passage for the metal to be cast which undergoes peripheral solidification on contact with its wall, is a feed head made of a thermally insulating refractory intended to contain, in the liquid state, a volume of cast metal delivered by the tundish placed above it (BF 2,000,365).

Thus, by virtue of a "two-material" mold of this type, it is possible for the free surface (meniscus) of the cast metal, which then lies within the feed head, to be distanced from the point where the cast metal on contact with the cold wall necessarily starts to solidify, namely the upper edge of the copper component.

Thus, the aim is to produce, by continuous casting, semifinished products of a higher quality and with high extraction rates, which are even higher than in conventional continuous casting. This is because any hydrodynamic turbulence caused by the influx of molten metal into the mold is confined within the refractory feed head so that, below it, solidification can commence and continue in a calm environment in which the cast steel progresses towards the output end of the mold without any significant velocity gradients in the section ("plug"-type flow).

It has been envisaged to design the refractory feed head itself in two superposed separate parts. An upper part—the bush—made of a refractory which is thermally very insulating, and therefore generally made of a fibrous refractory which has quite a low density in order to prevent any spurious solidification on the internal wall of the bush by the cast metal cooling when coming into contact with it, and a lower part, of smaller size and internally aligned with the mold body—the annulus—made of a compact refractory, and therefore having good mechanical strength so as to withstand the mechanical erosion caused by the proximity of the tip of incipient solidification on the upper edge of the copper body in contact with the end of the feed head. An example of a compact refractory which may be suitable for this purpose is SiAlON (or Sialon®).

Other materials may also be suitable, but they all have the drawback of being expensive to use since, although very strong, they end up by being worn away, which means that the used annulus has to be replaced by a new annulus after a relatively short period of time.

SUMMARY OF THE INVENTION

The object of the present invention is to provide a solution which allows the working life of a refractory annulus of this type to be very substantially extended so as to make the running costs associated with renewing this annulus in a hot-top continuous casting machine reasonable.

For this purpose, the subject of the invention is a two-material mold for the vertical hot-top continuous casting of metals, such as steel, comprising a metal body (made of copper or copper alloy), which is vigorously cooled and defines a passage for the metal to be cast which, on contact with its internal wall, undergoes peripheral solidification, and a feed head made of a thermally insulating refractory which sits on the cooled metal body and is intended to contain, in the liquid state, the molten metal poured from a tundish placed above it, which mold is distinguished by the fact that the feed head is formed by two superposed separate refractory parts—an upper bush made of a refractory having good thermal insulation properties and a lower annulus made of a refractory material having good mechanical strength properties and internally aligned with the mold body—and that the annulus is crimped into a reinforcing means whose height is less than that of the annulus.

When casting long products, which will be the sole case considered below, this reinforcing means advantageously consists of a crimping ring, preferably made of steel, surrounding the annulus.

As will have been understood, the invention therefore consists in crimping the hard refractory annulus (made of SiAlON)—which otherwise might crack or even shatter after only a few casting runs—by means of a reinforcing ring, for example made of steel, which surrounds only the middle part of the perimeter of the annulus so as to leave a free portion of the latter to extend above and below the reinforcing ring.

By virtue of such an arrangement, the lower edge of the annulus in contact with the cast metal may be readily restored by facing the face turned toward the cooled metal body if degradation or spalling of the annulus is observed.

Furthermore, taking into account the potential symmetry of the arrangement, after the successive uses have exhausted the capacity of the lower face of the annulus to be regenerated, it is easy to turn the latter upside down, thereby inverting the upper face and lower face, for a new series of casting runs. It is thus possible to double the working life of the compact-refractory annulus and therefore to halve its effect on the cost of running the casting machine.

BRIEF DESCRIPTION OF THE DRAWINGS

The invention will be clearly understood and other aspects and advantages will be more clearly apparent in light of the following description given by way of an embodiment with reference to the appended single plate of drawings, in which.

In the figures, the same components are denoted by identical reference numbers.

DESCRIPTION OF THE PREFERRED EMBODIMENTS

Figure 1:
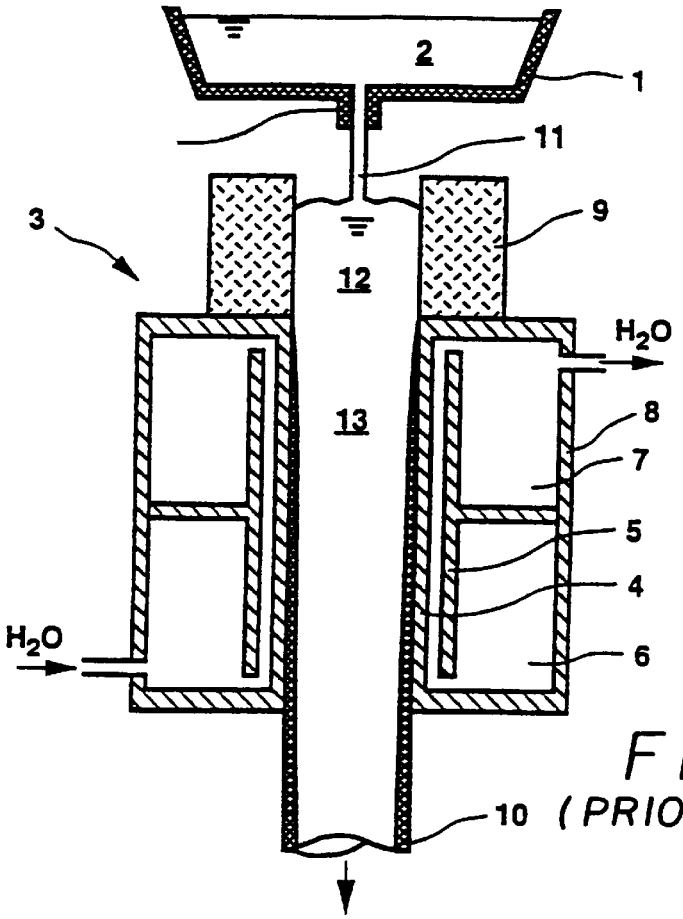
FIG. 1 (PRIOR ART)
FIG. 1 shows diagrammatically, in vertical section, the top of a vertical hot-top continuous casting machine for casting steel billets.

Referring to the general view in FIG. 1, it may be seen that the upper part of a machine for the vertical hot-top continuous casting of steel consists, in the direction of extraction of the metal to be produced, i.e. from the top downward in the figure, of a tundish 1 containing a bath of molten metal 2 which it delivers to a mold 3 (or several molds 3) placed beneath it by means of an outlet orifice (or several outlet orifices) extended by a guide nozzle 20.

As may be seen, the mold comprises a tubular copper body 4 which is vigorously cooled by the circulation of water over the length of its external face. Conventionally, a steel liner 5 is provided for channeling this circulation and communicates at its ends with an inlet chamber 6 and with a discharge chamber 7, these chambers being delimited by a casing 8 surrounding the cooled metal body 4 at some distance therefrom.

Sitting on top of the latter is a feed head 9 made of an uncooled refractory, the internal wall of which is preferably aligned with that of the body 4.

In the context of the casting process, the "cooled metal body 4 preceded by the insulating refractory feed head 9" arrangement defines a passage for the cast metal, the upper part of which passage, within the feed head, is a region 12 for confining the hydrodynamic perturbations caused by the arrival of the stream 11 of molten metal into the mold and the lower part of which passage, which extends it, is a region 13 for solidification of the cast metal. This solidification, as will be seen, begins right from the first contact of the cast steel with the internal wall of the cooled copper body 4, namely along the upper edge 14 of this wall, and continues downstream, forming a solid shell 15 which grows in thickness from the periphery toward the centre. On leaving the mold, the shell 15, which has a thickness of slightly more than one centimeter, is strong enough to withstand the ferrostatic pressure of the still-liquid core and continues its centripetal growth until the cast semifinished product 10 has completely solidified under the effect of the water spray units (not shown) which are located in the bottom half of the machine. Once the semifinished product has completely solidified, it is cut into portions of the desired width (billets, blooms or slabs, depending on the format of the cast section) and these portions are then available for subsequent forming operations (rolling, etc.).

Figure 2:
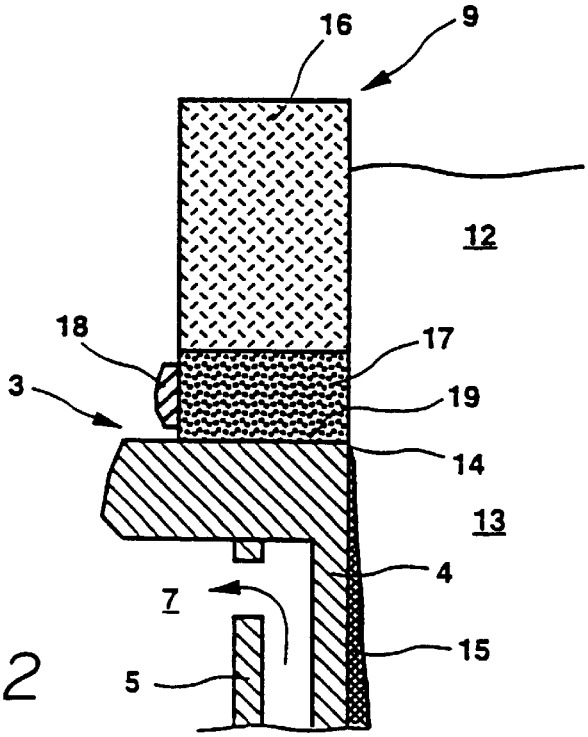
FIG. 2 shows, in partial vertical section, the detail of the upper part of a vertical hot-top continuous casting mold according to the invention.

Referring now more particularly to FIG. 2, it may be seen that the refractory feed head 9 is itself formed by stacking two separate components:

an upper component—the bush 16—made of a refractory chosen for its thermal insulation properties, since it has to prevent any premature spurious solidification of the cast metal in the turbulence region 12. The material of choice will be an alumina-based fibrous refractory, for example the material sold under the name A 120K by the French company KAPYROK s.a.; and a lower component—the annulus 17—made of a refractory chosen for its good mechanical strength since, in the vicinity of the crystallizer 4, it has to withstand as best as possible the mechanical erosion by the upper tip of the solid shell 15 on the edge 14 while the whole system undergoes a vertical oscillatory motion which, as is known, is necessary for the success of the casting operation, and the thermomechanical stresses of a machine operating in thermal cycles imposed by the necessarily sequential nature of the casting process.

This annulus 17, for example made of SiAlON, preferably doped with boron nitride, as sold by the company VESUVIUS under the reference 531, is crimped in a metal ring 18 in the factory by hot fitting. This avoids the risk of the annulus cracking or shattering, something which may otherwise occur after a small number of casting runs, or even after each casting run. According to the invention, this crimping ring is placed around the annulus and has a width dimension so as to allow the latter to extend on either side of the confines of the ring.

In order to be specific, it will be possible, for example, to surround an annulus 17 three centimeters in height using a steel ring 18 two and a half centimeters wide placed around the perimeter of the annulus in a central (and preferably symmetrical) position so as to allow the annulus to extend beyond the ring by a distance of two and a half millimeters on each side.

As was mentioned, this arrangement makes it possible, in the event of damage or of spalling, to restore the face 19 of the annulus turned toward the metal body 4 by facing. Ordinarily, a facing operation consumes a thickness of 0.1 to 0.2 mm of material.

Furthermore, once the limit of possible successive facing operations is reached, and the lower surface is therefore flush with the ring 18, it is easy to turn the annulus upside down and thus to return to the same situation as the starting situation for a new series of casting runs before the worn annulus has to be changed for a new annulus.

It goes without saying that the invention is not limited to the example described above but extends to many variants or equivalents as long as the essential characteristics of the invention, which are given in the appended claims, are respected.

In particular, "ring" in the sense of the present description should be understood to mean not only a continuous hoop, which may be put in place around an annulus 17 of circular shape in the case of the vertical continuous casting of long products (blooms and billets), but also any clamping means which provides the refractory annulus with mechanical reinforcement allowing it to better withstand the high thermomechanical stresses that it experiences because of the cyclic nature of the casting operations.

In the case of the continuous casting of flat products or of products having a highly elongate crosssection, especially slabs, and employing a refractory annulus which is no longer continuous around the perimeter of the mold, but formed by a juxtaposition of segments, for example, this reinforcing means may then advantageously consist of a U-clamp which compresses, by its ends, the abutting faces of each segment, the central part extending over the external face of the segment.

Moreover, although it is preferred, the arrangement shown in the figures, which shows that there is alignment between the feed head and the cooled metal body, is not essential for the implementation of the invention.

What is claimed is:

1. A two-material mold for the hot-top continuous casting of metals, comprising: a metal body which is vigorously cooled and defines a passage for metal to be cast which, on contact with its internal wall, undergoes peripheral solidification, and a feed head made of a thermally insulating refractory which sits on top of the metal body and is adapted to contain molten metal introduced into the mold, the feed head being formed by two stacked internally-aligned and separable refractory components, including an upper bush made of a refractory having high thermal insulation properties, and a lower annulus made of a refractory having higher mechanical strength properties than said upper bush, the lower annulus having a reinforcing member surrounding its exterior, said member having a height less than that of the annulus and said annulus having opposing end faces for engaging said upper bush and said metal body, respectively, and a symmetrical shape with respect to a plane extending between and parallel to said end faces such that either end face may engage said metal body.

2. The mold as claimed in claim 1, wherein the reinforcing member is in a central position, centered with respect to the height of the annulus.

3. The mold as claimed in claim 1, wherein the reinforcing member is a crimping ring surrounding an annulus of circular shape.

* * * * *